United States Patent [19]

Tameo

[11] 3,973,453

[45] Aug. 10, 1976

[54] RADIAL LINE PUNCH

[75] Inventor: Gerald N. Tameo, East Providence, R.I.

[73] Assignee: Sheldahl, Inc., Northfield, Minn.

[22] Filed: Aug. 20, 1975

[21] Appl. No.: 606,308

[52] U.S. Cl. ..... 83/30; 83/620; 83/636; 83/639; 83/660; 83/695

[51] Int. Cl.[2] ..... B26F 1/18

[58] Field of Search ..... 83/30, 52, 620, 636, 83/639, 695, 599, 660

[56] References Cited

UNITED STATES PATENTS

| | | | |
|---|---|---|---|
| 3,263,547 | 8/1966 | Pfaff, Sr. et al. | 83/620 |
| 3,274,869 | 9/1966 | Piazze | 83/620 X |
| 3,802,324 | 4/1974 | Izumi et al. | 83/30 X |
| 3,898,899 | 8/1975 | Weinstein | 83/620 X |

*Primary Examiner*—Frank T. Yost
*Attorney, Agent, or Firm*—Orrin M. Haugen

[57] ABSTRACT

A method and apparatus for the perforation of flexible film products, specifically flexible film bags wherein openings are provided for releasable retention of the bags on a wicket pin. Means are provided to form first and second openings, with said first opening comprising a plurality of spaced line slits intersecting generally at the mid-points thereof to form arcuately spaced wicket pin receiving sectors, and with one of said line slits being disposed generally parallel to the axis of the film bag. The second opening comprises a single line slit in projected continuation with that line slit of the first opening which is disposed parallel to the film bag axis, with the slit forming the second opening being disposed between the top open edge of the film bag and that line slit of the first opening which is parallel to the film bag axis.

4 Claims, 8 Drawing Figures

RADIAL LINE PUNCH

BACKGROUND OF THE INVENTION

The present invention relates generally to an improved system for perforating film bag structures, and more specifically to a method and apparatus for the perforation of flexible film bags for releasable retention on wicket pins.

In the dispensing of flexible film bags, such as polyethylene bags or the like, it is frequently desirable to retain a plurality of superimposed bags on a wicket pin member for individual dispensing of the bags. Dispensing is accomplished by the user or consumer gripping the bag structure along the body thereof and pulling the bag away from the pin so as to tear a portion of the bag lip to achieve release of the bag. Normally, the flexible film bags are of a J-fold style, with the upper lip portion being perforated to receive the wicket pins.

In the past, it has been conventional to form circular openings in the bag body, particularly along the bag lip, so as to provide a means for access of the pins. However, the utilization of such punches provides two primary disadvantages, the first being the capture of the individual slugs formed during the perforating operation, the second being the requirement to maintain the perforator punch in reasonably sharpened condition. With regard to the individual slugs which are not properly captured and retained, these slugs may either contaminate the interior of the bag structures, or are otherwise free to collect as debris in the area and environment. Even with regard to those slugs which are successfully captured and retained, means must be provided for the periodic removal of these items.

SUMMARY OF THE INVENTION

In accordance with the present invention, an improved perforator punch is provided which forms a wicket pin receiving opening in the bag structure, and which does not form slugs. The punch device is one which forms a pair of openings, the first being an opening comprising at least two arcuately spaced line slits intersecting generally at the mid-points so as to form a wicket pin receiving zone, and with the primary one of these slits being disposed generally parallel to the axis of the film bag. A second opening is formed adjacent the first opening, with the second opening comprising a single line slit in projected continuation with the primary line slit of the first opening. The purpose of the second opening is to provide a lead-slit which improves and facilitates easy removal of the bag structures from the wicket pins, and does not form rips or tears in the film which detract from the general overall appearance of the finished product.

Therefore, it is a primary object of the present invention to provide an improved method and apparatus for the perforating of flexible film bags for the releasable retention of the film bag on a wicket pin, and wherein there are no individual slug elements formed during the perforating operation.

It is a further object of the present invention to provide an improved method and apparatus for the perforating of flexible film bags for the releasable retention of the bags on a wicket pin, and wherein the bag structures are provided with first and second openings, with the first opening comprising at least two arcuately spaced line slits intersecting generally at the mid-points thereof, with the primary one of said arcuately spaced line slits being in generally parallel alignment with the film bag axis, and with a second opening comprising a single line slit in projected continuation with the first line slit and being disposed between the top open edge of the film bag and the primary line slit.

It is yet a further object of the present invention to provide an improved apparatus and technique for the perforation of flexible film bags wherein the perforation arranges the film bags for releasable retention on a wicket pin, and wherein the operation is conducted without the generation of film slugs, and wherein the perforator punch requires only infrequent maintenance.

Other and further objects of the present invention will become apparent to those skilled in the art upon a study of the following specification, appended claims, and accompanying drawings.

DESCRIPTION OF THE PREFERRED EMBODIMENT

Figure 1:
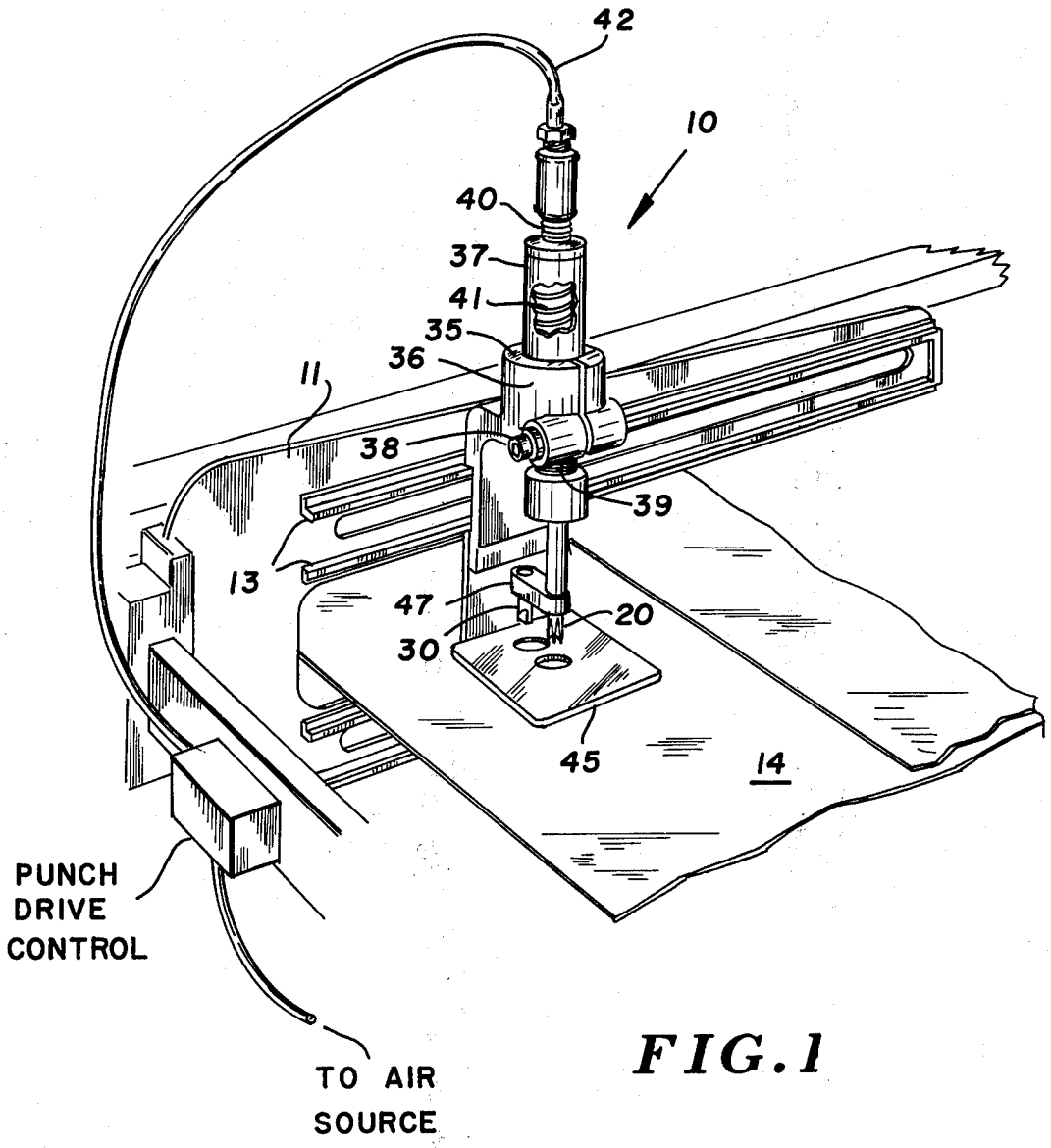
FIG. 1 is a front perspective view of a typical punch assembly arranged in accordance with the present invention, and in operational relationship on a transversely extending bracket, and being driven with a drive and control system, the punches being shown with a web of flexible film material being moved between the punches and a die base or plate.

In accordance with the preferred embodiment of the present invention, and with particular attention being directed to FIG. 1 of the drawings, there is illustrated a punch assembly generally designated 10 mounted on a transversely extending mounting bracket 11. Means are provided for adjusting the lateral positioning of the punch 10 on the bracket 11, these means including, for example, the provision of mounting rails such as are shown, for example, at 13. The work web of film material is shown generally at 14, and, as indicated, passes beneath the operational or working face of punch 10. With attention being directed to FIG. 2 of the drawings, a cooperating die assembly is shown generally at 15, this die assembly being disposed immediately below the surface of the film 14, and being arranged to retain the punch structure appropriately.

It will be appreciated that cooperating punch and die systems are frequently used in connection with the processing of flexible film, and one such system is illustrated in detail in U.S. Pat. No. 3,580,120, Richard C. Adams, et al., and assigned to the same assignee as the present invention. Reference is made to U.S. Pat. No. 3,580,120 for a typical showing of the operational details of a punch and die assembly and including the punch actuating mechanism and control mechanism of the type which may be employed in connection with the present invention.

Figure 5:
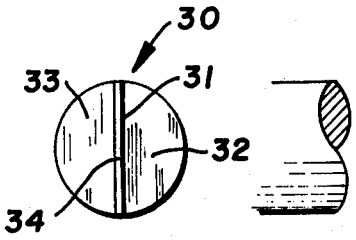
FIG. 5 is a view similar to FIG. 4 of that punch member having a single cutting line face thereon, with the cutting tip being otherwise similar to that illustrated in FIG. 3.
Figure 3:
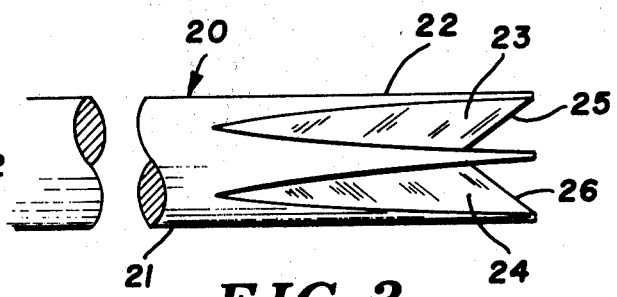
FIG. 3 is a detail elevational view on a slightly enlarged scale, and illustrating the cutting tip thereof.
Figure 4:
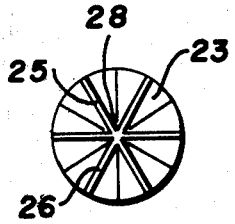
FIG. 4 is an end view of the cutting tip of the structure of FIG. 3, and illustrating the plurality of radially extending cutting line faces thereon.

With attention being temporarily directed to FIGS. 3, 4 and 5, the individual punch elements shown include, as in FIG. 3, a punch structure generally designated 20 having a shank portion 21, and a cutting tip portion 22. The cutting tip portion has a plurality of radially converging grooves such as the grooves 23 and 24, with these grooves 23 and 24 being formed adjacent the working tip and converging radially inwardly toward the working tip. The structure thereby forms a plurality of radially extending cutting line faces such as the faces 25 and 26, with these cutting line faces extending generally diametrically of the tip and with the cutting faces having an inwardly converging profile such as is apparent from FIG. 3. Furthermore, it is apparent that the individual cutting line faces have a common intersecting point such as at 28 (FIG. 4) which is, incidentally, disposed along the axis of the punch member, including both the axis of the shank 21 and the cutting tip 22. With attention now being directed to FIG. 5, it will be observed that the structure therein illustrated includes a punch structure generally designated 30 having a cutting line face 31 formed therein, resulting from the pair of converging faces 32 and 33. Preferably, the cutting line faces of punch 30 are arranged so as to have an inwardly converging profile which profiles reaches an apex as at 34, apex 34 being, of course, disposed along the axis of punch 30.

With attention being re-directed to FIG. 1 of the drawings, punch 10 includes a mounting head 35, the head having a support sleeve configuration as at 36 so as to adjustably retain the punch drive cylinder 37 therewithin. In other words, the drive cylinder 37 is received within the confines of the split head 35, and may be disposed at any preferred elevation relative to the surface of the film 14, adjustable clamping screw being provided as at 38 to accomplish this purpose. The punch is provided with a rod, ram, or shank portion 39 which is arranged to receive the shank of punch 20 at the forward end thereof, the arrangement being such that the ram 39 and punch 20 are moved reciprocably within or through a bore formed in die 15, with motion being provided by the drive cylinder 37 as shown in detail in FIGS. 1 and 2.

Figure 2:
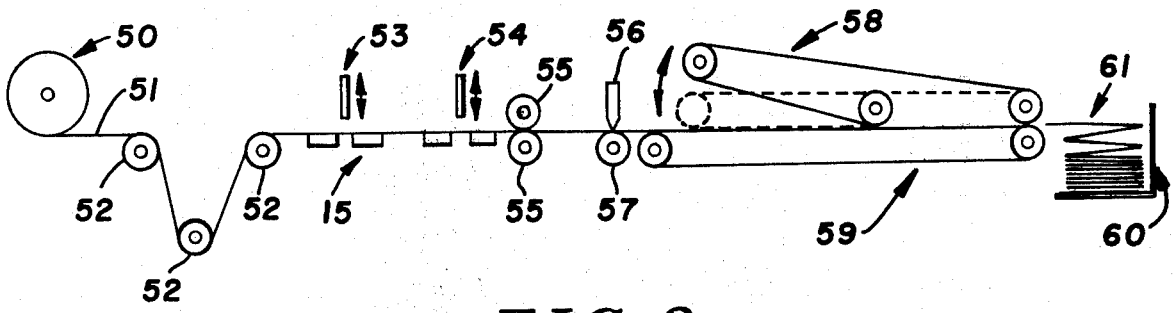
FIG. 2 is a schematic view of a typical film processing system for the preparation of flexible film bags, and illustrating the relationship in the system of a pair of punching stations in accordance with the present invention.

The details of the action of the drive and control system are described in detail in U.S. Pat. No. 3,580,120, and reference is made to that patent for a complete description of this system. However, as illustrated in FIGS. 1 and 2, means are provided to transmit fluid under pressure to the upper cylinder port 40 of cylinder 37 for driving the punch 20 downwardly, with a spring member such as is shown at 41 being utilized to return the punch to its upper normal disposition. Of course, it will be appreciated that a double-acting cylinder may be employed to drive punch 20 in its reciprocatory path during normal operation. Suitable guide means and bushings are provided along with appropriate O ring seals to prevent leakage of compressed fluid such as compressed air around the moving shank or ram portion, as is conventional in this type of drive system. Compressed air for driving the device is provided through the line as at 42, and conventional exhaust ports are utilized for relieving the pressure within line 42 and cylinder 37 so as to permit spring 41 to return the ram to its upper normal position. Such drive systems are, of course, well known in the art and conventionally employed in connection with the structure of the present invention.

With continued attention being directed to FIG. 1 of the drawings, it will be observed that the assembly includes a shoe element 45 which is utilized as a hold-down member to assist in guiding the film during the draw and dwell cycles.

As has been indicated, the punch members 20 and 30 are arranged so as to function in a simultaneous fashion from a single drive member. In this connection, a bracket may be provided adjacent punch 20 so as to receive and retain punch member 30 in laterally disposed relationship thereto, with such a bracket being shown at 47. In this fashion, coupling bracket 47 can be utilized to drive both punch members 20 and 30 simultaneously along their reciprocatory cutting path.

In order to drive the punch systems, compressed air will be delivered to the control valves at approximately 100 psi, this type of compressed air being normally available in manufacturing installations. A control system such as is illustrated in U.S. Pat. No. 3,580,120 is utilized to control the pulses of compressed air through line 42 and into drive cylinder 37. Such operation is, as indicated, conventional.

Attention is now directed to FIG. 2 of the drawings wherein a conventional system is schematically illustrated. Specifically, the feed roll generally designated 50 provides a J-folded web such as is illustrated at 51, with the web passing through guide rolls and dancer rolls 52—52, as is conventional. The web 51 continues its path and reaches punching stations generally designated 53 and 54, with each of these stations utilizing the punch system as illustrated in FIG. 1. It will be appreciated that only one such station may be employed, however for certain operations and applications, more than one such station may be utilized. Draw rolls for the apparatus are illustrated at 55, and a sealing bar is shown at 56 which operates against the surface of sealing roll 57. A pick-off assembly is illustrated generally at 58, with the pick-off assembly functioning with a conveyor generally designated 59 including upper and lower conveyor runs. The punched, perforated and separated film bag products are received in the zone 60, with the superimposed stack being illustrated generally at 61.

The schematic illustration of FIG. 2 is typical of bag-making machines which are in use in commerce at this time. Specifically, the draw rolls 55—55 are arranged to intermittently draw the web 51 along the path from the supply roll 50 to the discharge station as at 60. During the dwell cycle, the punches 53 and 54 will be set into operation, as will the sealing bar 56. During the draw cycle, the web 51 will be moved forwardly so as to provide a completed operational cycle. One such bag-making machine is disclosed in detail in U.S. Pat. No. 2,947,345, Gilmore T. Schjeldahl, dated Aug. 2, 1960 and reference is made to that patent for a complete description of a typical bag-making machine.

Figure 6:
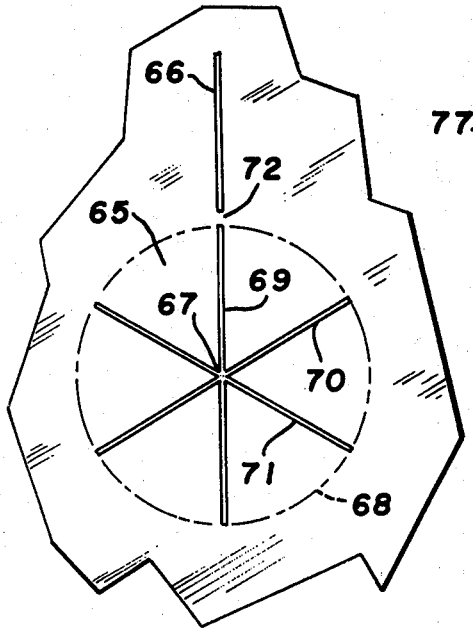
FIG. 6 is a top plan view, on a slightly enlarged scale, of a fragmentary portion of a flexible film product having perforations formed therein in accordance with the present invention.
Figure 7:
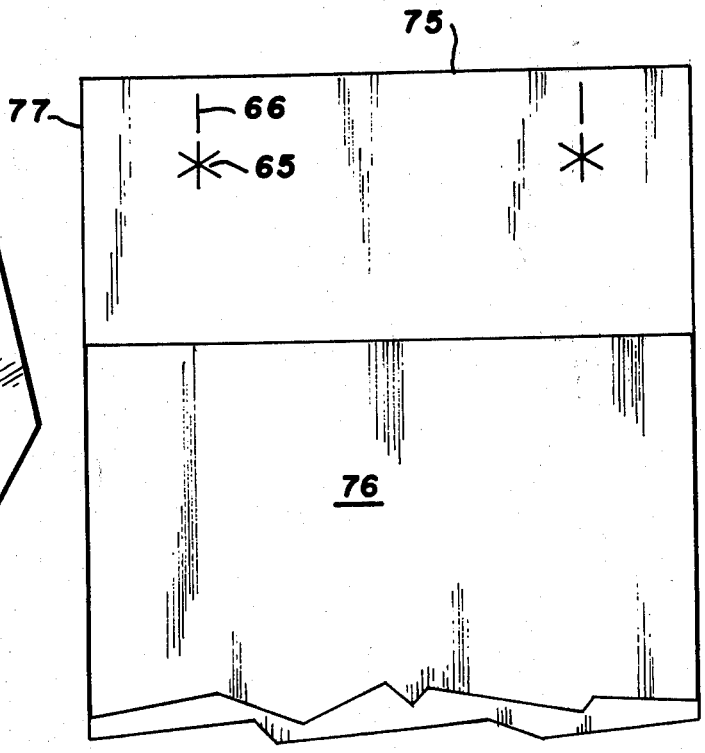
FIG. 7 is a top plan view of the upper portion of a flexible film bag prepared from J-fold material, and having perforations formed in the upper lip portion.

Turning now to the configuration of the finished product, attention is directed to FIGS. 6 and 7 for this discussion. A pair of punched openings are provided, such as illustrated at 65 and 66 in FIGS. 6 and 7, with the perforated opening 65 comprising three arcuately spaced line slits intersecting generally at a mid-point 67 to form a generally circular opening, as defined by the phantom line 68 which joins the outer radial extremities of each of the arcuately spaced line slits, such as the slits 69, 70 and 71. Line slit 66 is in projected continuation with line slit 69, with a web zone 72 being formed therebetween. Upon receiving a wicket pin therethrough, the web zone 72 becomes ruptured upon a force being applied on the bag preparatory to removal, with the line slit 66 thereby functioning as a tear-assisting slit.

With attention being directed to FIG. 7, it will be observed that the bag structure 75 shown therein includes a bag portion 76 along with an upper or overhanging lip 77. It is this structure which is fabricated from a J-fold web so as to provide a double wall thickness in the bag portion 76 with the single wall thickness in the overhanging lip portion 77. The perforations are illustrated, as at 65 and 66 so as to achieve ready removal of the structure from a wicket pin system.

Figure 8:
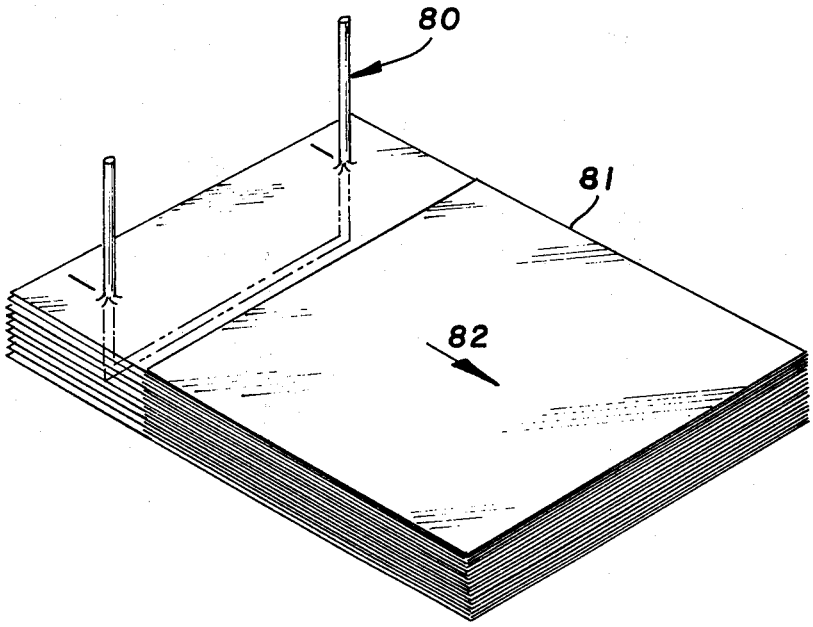
FIG. 8 is a side perspective view of a stack of film bags having the openings formed therein in accordance with the present invention, and being mounted on a wicket pin in stacked superimposed relationship.

With attention being directed to FIG. 8, it will be observed that the wicket pin assembly which is in the form of a generally U-shaped member, as is illustrated generally at 80, extends through the perforations formed in each of the bags making up the stack of bags identified at 81. Accordingly, removal of the bags in the direction of the arrow 82 will cause a perforation of the upper lip portion so as to achieve suitable removal.

I claim:

1. In combination with a punch assembly for perforation of flexible film products with cooperatively arranged punch and die assemblies, punch drive means and control means for said punch drive means:

a. said punch assembly including frame means for retaining reciprocating punch means and stationary die means, first and second punch assemblies, each including a punch member mounted on said frame means and including drive means for stroking said punch members in reciprocatory to-and-fro motion for extension and retraction thereof along a certain linear path;

b. a die assembly mounted on said frame means and having a punch receiving bore formed therein;

c. said first punch member comprising a shank portion with a concave cutting tip at one end thereof and having a plurality of radially converging grooves formed therein adjacent said cutting tip and converging radially inwardly toward said cutting tip so as to form a plurality of radially extending cutting line faces extending generally diametrically of said tip with said cutting faces having an inwardly converging profile and a common intersecting point along the axis of said shank; and d. said second punch member comprising a cutting line face disposed in radially spaced relationship from said first cutting line face and extending generally in projected continuation with one of said diametrical extending cutting faces.

2. The combination as defined in claim 1 being particularly characterized in that said first punch member includes three cutting line faces extending generally diametrically of said cutting tip and being spaced apart at substantially equal arcuate dispositions.

3. The method of perforating flexible film bags for releasable retention on a wicket pin and including the steps of:

a. perforating said film to form first and second openings therein, said first opening comprising at least two arcuately spaced line slits intersecting generally at the mid-points thereof to form a plurality of arcuately spaced wicket pin receiving sectors, with the primary one of said arcuately spaced line slits being disposed generally parallel to the axis of the film bag;

b. said second opening being spaced from said first opening and comprising a line slit in projected continuation with said primary line slit and being disposed between the top open edge of said film bag and said primary line slit.

4. The method as defined in claim 3 being particularly characterized in that said first opening comprises three substantially equally arcuately spaced line slits.

* * * * *